United States Patent [19]

Frommherz

[11] Patent Number: 4,651,974

[45] Date of Patent: Mar. 24, 1987

[54] CONTINUOUS WINCH

[75] Inventor: Egon Frommherz, Steinen, Fed. Rep. of Germany

[73] Assignee: Rotzler GmbH + Co. Spezialfabrik für Seilwinden und Hebezeuge, Steinen, Fed. Rep. of Germany

[21] Appl. No.: 405,148

[22] Filed: Aug. 4, 1982

Related U.S. Application Data

[63] Continuation-in-part of Ser. No. 124,072, Mar. 17, 1981, abandoned.

[30] Foreign Application Priority Data

Jul. 12, 1979 [DE] Fed. Rep. of Germany ..... 2938078

[51] Int. Cl.[4] ..... B66D 1/36; B66D 1/14

[52] U.S. Cl. ..... 254/294; 242/47.08; 254/371

[58] Field of Search ..... 254/371, 333, 372, 310, 254/373, 311, 278; 242/117, 155 BW, 47.01, 47.08; 74/230.17

[56] References Cited

U.S. PATENT DOCUMENTS

| | | | |
|---|---|---|---|
| 3,666,239 | 5/1972 | Koshihara | 254/310 |
| 3,680,839 | 8/1972 | Mattinson | 254/333 |
| 3,750,970 | 8/1973 | Tremoulet, Jr. | 254/333 |
| 3,776,519 | 12/1973 | Hamilton | 254/333 |
| 4,193,311 | 3/1980 | Rinio et al. | 254/371 |

*Primary Examiner*—Billy S. Taylor

*Attorney, Agent, or Firm*—Becker & Becker, Inc.

[57] ABSTRACT

A continuous winch with two, drums at least one of which is driven and is provided with a multiple groove configuration with one discharge groove for the non-loaded cable. The non-loaded, running-off, or discharging cable in the discharge groove is capable of being stressed or tensioned transverse to the discharge direction. The discharge groove is limited by a tensioning disc which is spring-loaded in the tensioning direction. The tensioning disc is capable of being lifted from the cable counter to spring-loading by a hydraulically engaged stroke piston. The cable exit groove, which is located opposite the discharge groove in the axial direction of the drums, is limited by a clamping disc, which is capable of being tensioned by a hydraulic pressure piston against the cable. The stroke piston of the tensioning disc, and the pressure piston of the clamping disc, are coupled by a hydraulic control and are capable of being engaged by pressure in opposite directions with respect to the cable.

3 Claims, 4 Drawing Figures

CONTINUOUS WINCH

This a continuation-in-part of parent application Ser. No. 124,072- Frommherz filed Mar. 17, 1981, now abandoned.

The present invention relates to a continuous winch, hoist, capstan or windlass with two drums, at least one of which is driven and is provided with a multiple groove configuration with one discharge groove for the non-loaded cable. The non-loaded, running-off or discharging cable in the discharge groove is capable of being stressed or tensioned transverse to the discharge direction. The discharge groove is limited by a tensioning disc which is spring-loaded in the tensioning direction. The tensioning disc is capable of being lifted from the cable counter to spring loading by a hydraulically engaged stroke piston. Such a continuous winch is disclosed by U.S. Pat. No. 4,225,119-Frommherz, issued Sept. 30, 1980.

With continuous winches having a great pulling force, a correspondingly strongly dimensioned wire cable is used with, for instance, a 35 mm diameter. Such a cable has a great stiffness. In order to be able to let out or extend the cable, the continuous winch is driven in reverse or opposite direction. In other words, there exists the danger that the cable, which is shifted or pushed from behind by the tensioning disc clamping, also binds, hangs up, or catches so as to lift from the drum in the continuous winch due to its great stiffness, so that the withdrawal of the cable is affected.

Accordingly, the object of the present invention is to improve the continuous winch of the aforementioned type in such a way that during rearward running, a taut or tight looping of the cable around the drum is assured.

This object, and other objects and advantages of the present invention, will appear more clearly from the following specification in connection with the accompanying drawings, in which.

The continuous winch of the present invention is characterized primarily in that the cable exit groove, which is located opposite the discharge groove in the axial direction of the drum, is limited by a clamping disc, which is capable of being tensioned by a hydraulic pressure piston against the cable; furthermore, the stroke piston of the tensioning disc, and the pressure piston of the clamping disc, are coupled by a hydraulic control and are capable of being engaged by pressure in opposite directions with respect to the cable.

Consequently, the advantage is attained that for withdrawal or traveling-out of the cable during rearward rotation of the continuous winch, on the one hand the tensioning disc is lifted from the cable by means of the stroke piston, so that no pushing or shearing force or tangential stress is effective upon the cable, while on the other hand, at the cable exit, a tensioning of the cable in the cable exit groove is effected by the pressure-piston-loaded clamping disc, so that during the rearward rotation of the drum, a stress or tensioning is effective upon the cable in the region of the continuous winch, as a result of which the cable remains stiff or rigid in the peripheral grooves of the drum and does not lift from the drum, so that disturbances are avoided and a satisfactory withdrawal of the cable from the continuous winch is assured.

According to a preferred embodiment of the invention, it is advantageous that the medium of the hydraulic control be applied against the side of the pressure piston facing away from the clamping disc, so that without reversal a direct application or introduction of the contact force occurs in the pressure direction upon the clamping disc, and a simple compact embodiment is possible.

According to a further feature of the present invention, a roller bearing is arranged between the pressure piston and the clamping disc, so that during pressing of the clamping disc into engagement, an equalization of movement is possible between the parts, and a clamping, canting or twisting cannot arise.

Figure 1:
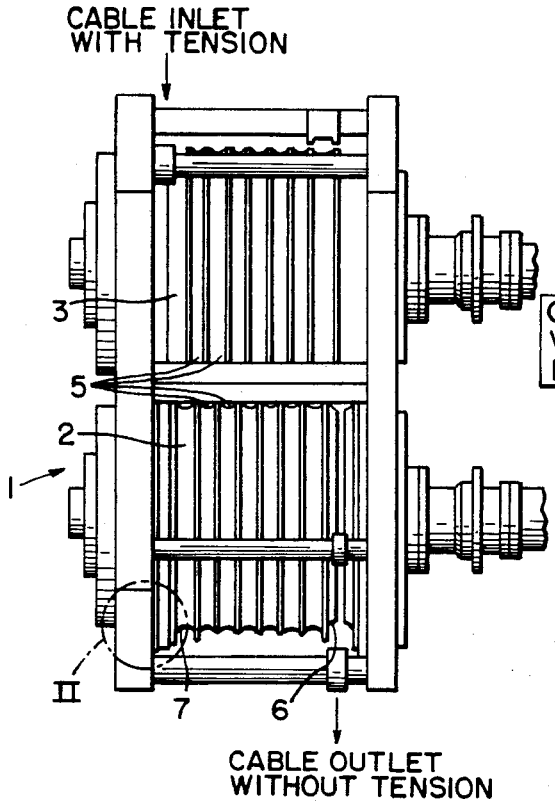
FIG. 1 is plan view of a continuous winch having features of a preferred embodiment of the present invention.

Referring now to the drawings in detail, the continuous winch 1, has two drums 2, 3, embodied as cable or hoisting drums, which are driven by a self-contained drive or transmission and a self-contained oil engine. Grooves 5 are provided around the periphery of the drums for guiding a cable 4, whereby with the lower drum 2 of FIG. 1 as well as FIGS. 2 and 3, at the right there is provided an uncoiling or discharge groove 6, and at the right there is provided a cable outlet or exit groove 7 from which the cable 4 is withdrawn downwardly in the direction of the arrow during backward or rearward extension or traveling out.

Figure 3:
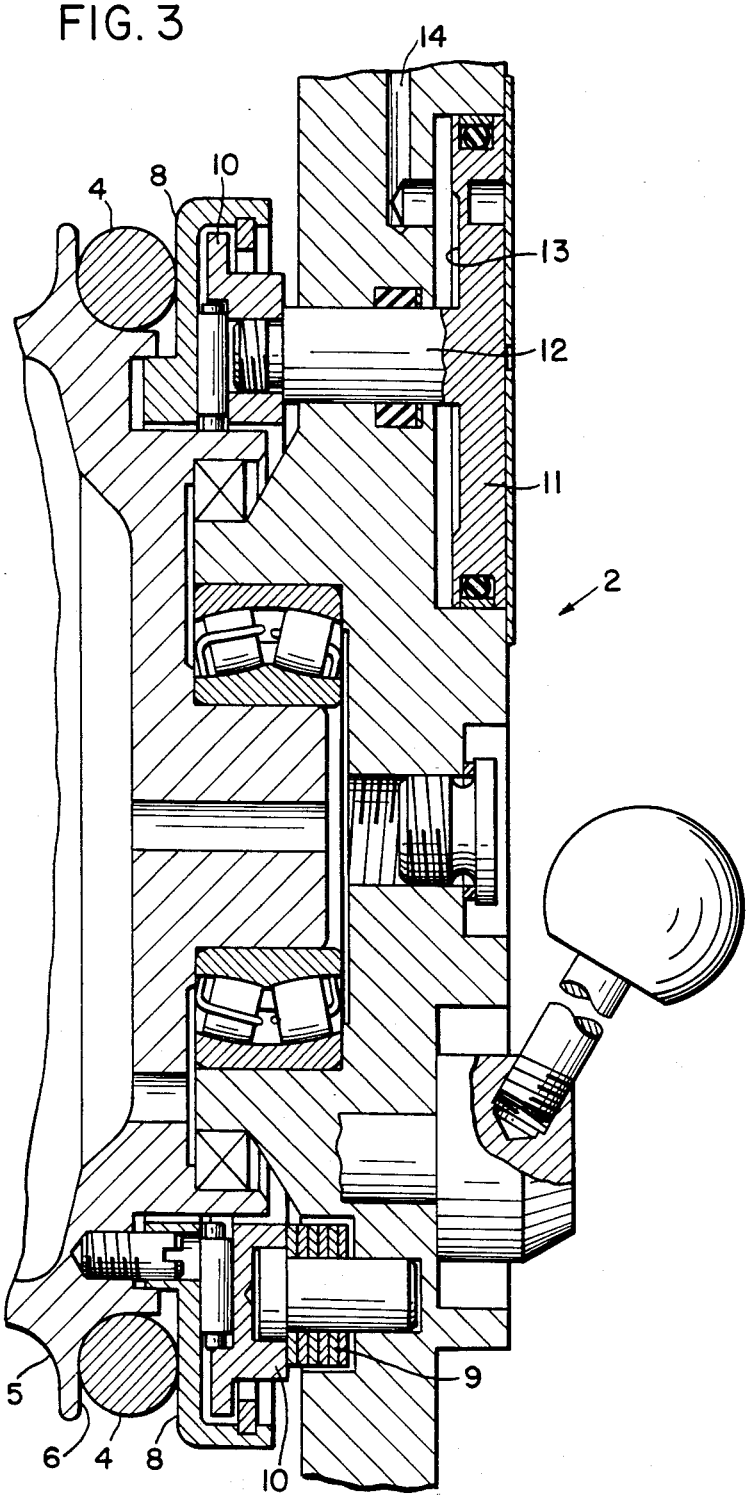
FIG. 3 is an enlarged fragmentary cross-sectional view of the cable outlet groove and drum end mounting in FIG. 1.

As especially recognizable in FIG. 3, the cable 4 is stressed or tensioned in the discharge groove 6 by a tensioning disc 8 applying tension transverse to the longitudinal direction, in that the force of a disc spring package 9 acts upon the tensioning disc 8 by way of a pressure ring 10. Additionally, a lift or stroke piston 11 is provided and is connected with the pressure ring 10 by a piston rod 12. The stroke or lift piston 11, on that side thereof facing the tensioning disc 8, has a pressure surface 13 against which the pressure medium that flows through the bore 14 is effective. As a result, the tensioning ring or disc 8 is capable of being lifted from the cable 4 against the force of the disc spring package 9.

Figure 2:
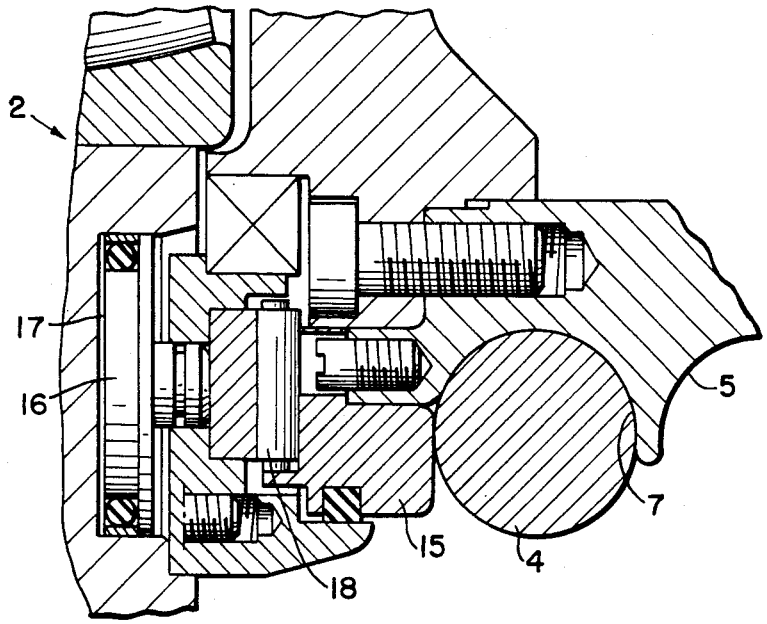
FIG. 2 is an enlarged fragmentary cross section taken in the region of the circle II in FIG. 1.

FIG. 2 shows that the cable exit groove 7 is limited or defined by a clamping disc 15. The clamping disc 15 is capable of being pressed against the cable 4 in that the pressure piston 16, on that piston surface 17 which faces away from the clamping disc 15, is engaged by a hydraulic pressure medium, whereby the pressure force is guided or directed onto the clamping disc 15 directed by a roller bearing 18.

The stroke piston 11 and the pressure piston 16 are coupled with each other by a hydraulic control means in such a way that during backward or rearward running of the continuous winch 1, the tensioning disc 8 lifts away from the cable 4 in the region of the discharge groove 6 by means of the stroke or lift piston 11, which is acted upon by pressure medium. Under these circumstances, the pressure piston 16 is likewise acted upon by pressure medium, so that here in the cable exit groove 7 the clamping disc 15 is pressed against the cable 4 because of the opposite direction of the pressure. Consequently, during rearward turning or traveling out, a taking-along effect is exerted upon the cable 4, and the cable is withdrawn in the front from the continuous winch 1. During forward running of the continuous winch 1, when the cable 4 is rolled up, there occurs a reversing of the lift or stroke piston 11 and the pressure piston 16 in such a manner that the hydraulic pressure is retracted or taken back, whereby the tensioning of the cable 4 in the cable exit groove 7 by the clamping disc 15 is discontinued, and likewise the lift or stroke piston 11 is no longer powered, so that the tensioning disc 8 clamps or tensions the cable 4 in the discharge groove 6 and, consequently, during forward rotation for attracting or reeling-up of the still unloaded cable 4, exerts a taking-along effect. Accordingly, an undesired lifting or other effect on the cable 4 which would preclude or hinder functioning thereof is avoided, and both during forward as well as during rearward running, a reliable cable guidance in the continuous winch 1 is assured.

In summary, the cable exit groove 7, which is located opposite the discharge groove 6 in the axial direction of the drum 2, is limited by a clamping disc 15, which is capable of being tensioned or clamped against the cable 4 by the hydraulic pressure piston 16. The stroke piston 11 of the tensioning disc 8, and the pressure piston 16 of the clamping disc 15, are coupled by a hydraulic control and are capable of being engaged by pressure in opposite directions with respect to the cable 4.

The pressure medium of the hydraulic control means is applied against that piston surface 17 of the pressure piston 16 facing away from the clamping disc 15.

A roller bearing 18 is arranged between the pressure piston 16 and the clamping disc 15.

Figure 1A:
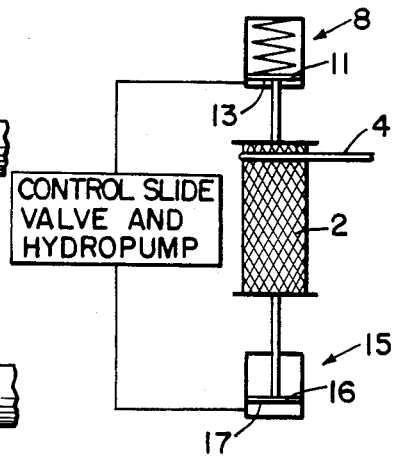
FIG. 1A is a schematic diagram of hydraulic control means usable with the winch of FIG. 1.

FIG. 1A is a schematic diagram of hydraulic control means showing hydraulic conduits or lines belonging to the pistons 11 and 16 being connected with each other by a hydraulic control such as a control shifter in such a manner that both pistons 11,16 are engageable with the pressure opposite to each other in relation to the cable 4, For this purpose the piston surface 13 of the stroke or lift piston 11 engageable with hydraulic medium in relation to the cable 4 on the one side and the engageable piston surface 17 of the pressure piston 16 can be arranged on the other side of the particular piston.

The present invention is, of course, in no way restricted to the specific disclosure of the specification and drawings, but also encompasses any modifications within the scope of the appended claims.

What I claim is:

1. A continuous winch for selectively rolling up and withdrawing a cable employed to lift loads held in any position without releasing or dropping thereof, comprising in combination:

two drums having therewith contoured surfaces, at least one of which is provided with a multiple groove configuration thereon, including a cable discharge groove for said cable without any load thereon, and a cable exit groove for cable having load thereon, said discharge and exit grooves being located at opposite ends of said at least one grooved drum when viewed in the axial direction thereof;

a tensioning disc which with contoured surfaces of said drum defines said discharge groove; tensioning means effective with a force upon said tension disc in one direction; said tensioning means being effective only when the cable is being retracted and serving to tension said tensioning disc axially against the cable in said discharge groove transverse to the discharge direction during retraction of the cable;

a first hydraulic piston for lifting said tensioning disc from said cable with a force opposite to that of said tensioning means;

a clamping disc which with the contoured surfaces of said drum defines said exit groove and serves to clamp said cable;

a second hydraulic piston for effecting clamping of said clamping disc; and means for coupling the actions of said first and second hydraulic pistons whereby, with respect to said cable, said pistons are engageable by pressure in opposite directions so that during pulling-out of the cable being withdrawn there is axial pressure upon the cable via said clamping disc that conversely is lifted via said first hydraulic piston with the force opposite to that of said tensioning means so that said tensioning disc no longer exerts any pressure upon the cable.

2. A continuous winch according to claim 1, in which combination said means for coupling includes pressure medium adapted to be applied against that piston surface of said second hydraulic piston which faces away from said clamping disc.

3. A continuous winch according to claim 1, which in combination includes a roller bearing arranged between said second hydraulic piston and said clamping disc.

* * * * *